US009694591B2

(12) United States Patent
Muyskens et al.

(10) Patent No.: US 9,694,591 B2
(45) **Date of Patent: *Jul. 4, 2017**

(54) FLUID LEVEL SENSING APPARATUS

(71) Applicant: FUNAI ELECTRIC CO., LTD., Daito-shi, Osaka (JP)

(72) Inventors: Robert H. Muyskens, Lexington, KY (US); Michael A. Marra, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/146,734

(22) Filed: May 4, 2016

(65) Prior Publication Data

US 2016/0243846 A1 Aug. 25, 2016

Related U.S. Application Data

(63) Continuation of application No. 14/430,475, filed as application No. PCT/IB2013/002820 on Sep. 24, 2013, now Pat. No. 9,358,800.

(Continued)

(51) Int. Cl.
*B41J 29/393* (2006.01)
*B41J 2/175* (2006.01)

(52) U.S. Cl.
CPC ..... *B41J 2/17566* (2013.01); *B41J 2/175* (2013.01); *B41J 2/17596* (2013.01)

(58) Field of Classification Search
CPC .... B41J 2/175; B41J 2/17596; B41J 2/17566; B41J 11/0095; B41J 11/009;

(Continued)

(56) References Cited

U.S. PATENT DOCUMENTS 9,358,800 B2 * 6/2016 Muyskens ..... B41J 2/175
2010/0238239 A1 9/2010 Shinkai
2011/0279495 A1 11/2011 Kuribayashi

FOREIGN PATENT DOCUMENTS

EP 1164025 A1 12/2001
EP 2103435 A2 9/2009

(Continued)

OTHER PUBLICATIONS

International Search Report of PCT/IB2013/002820 dated May 12, 2014.

*Primary Examiner* — Lamson Nguyen
(74) *Attorney, Agent, or Firm* — Amster, Rothstein & Ebenstein, LLP

(57) ABSTRACT

An inkjet printing system is disclosed and comprises at least one fluid reservoir containing a fluid, a fluid line that fluidly couples the at least one fluid reservoir with an imaging device, and a fluid level sensing apparatus fluidly coupled with the at least one fluid reservoir. The fluid level sensing apparatus comprises: a bottom portion having a fluid volume $V_B$; an intermediate portion vertically adjacent the bottom portion and having a fluid volume $V_I$, the intermediate portion including a first fluid sensor spaced vertically from a second fluid sensor; and an upper portion vertically adjacent the intermediate portion and having a fluid volume $V_u$, wherein $V_u>V_I>V_B$. The inkjet printing system also comprises a pump fluidly coupled with the at least one fluid level sensing apparatus and configured to exert fluid pressure along the at least one fluid level sensing apparatus.

19 Claims, 13 Drawing Sheets

Related U.S. Application Data

(60) Provisional application No. 61/704,679, filed on Sep. 24, 2012.

(58) Field of Classification Search
CPC ..... B41J 2/14153; B41J 11/008; B41J 11/42; B41J 2/04505; B41J 2/04541; B41J 2/0458; B41J 3/28; B41J 11/06; B41J 2/04508; B41J 2/04558; B41J 2/07
See application file for complete search history.

(56) References Cited

FOREIGN PATENT DOCUMENTS

| | | | |
|---|---|---|---|
| EP | 2110250 | A1 | 10/2009 |
| WO | 98/30394 | A1 | 7/1998 |
| WO | 2005/002860 | A1 | 1/2005 |
| WO | 2010/118225 | A1 | 10/2010 |

* cited by examiner

FLUID LEVEL SENSING APPARATUS

FIELD

The present invention is directed to apparatuses and methods for detecting fluid levels in inkjet printing systems.

SUMMARY

According to an exemplary embodiment of the present disclosure, an inkjet printing system is disclosed and comprises at least one fluid reservoir containing a fluid, a fluid line that fluidly couples the at least one fluid reservoir with an imaging device, and a fluid level sensing apparatus fluidly coupled with the at least one fluid reservoir. The fluid level sensing apparatus comprises: a bottom portion having a fluid volume $V_B$; an intermediate portion vertically adjacent the bottom portion and having a fluid volume $V_I$, the intermediate portion including a first fluid sensor spaced vertically from a second fluid sensor; and an upper portion vertically adjacent the intermediate portion and having a fluid volume $V_U$, wherein $V_U>V_I>V_B$. The inkjet printing system also comprises a pump fluidly coupled with the at least one fluid level sensing apparatus and configured to exert fluid pressure along the at least one fluid level sensing apparatus.

According to an exemplary embodiment, the fluid level sensing apparatus has an asymmetric configuration.

According to an exemplary embodiment, the inkjet printing system further comprises a vent fluidly coupled with the fluid level sensing apparatus.

According to an exemplary embodiment, the vent includes an aperture configured to transmit the fluid away from the fluid level sensing apparatus.

According to an exemplary embodiment, the inkjet printing system further comprises at least one valve disposed upstream of the fluid level sensing apparatus.

According to an exemplary embodiment, the inkjet printing system further comprises at least one valve disposed downstream of the fluid level sensing apparatus.

According to an exemplary embodiment, the first fluid sensor or the second fluid sensor is one of a light detector, a float, or a fluid sensing pin.

According to an exemplary embodiment, the time the fluid takes to reach first fluid sensor corresponds to a volume of fluid in the fluid reservoir.

According to an exemplary embodiment, the time the fluid takes to reach the second fluid sensor is used to calibrate a reading taken by the first fluid sensor.

According to an exemplary embodiment, the inkjet printing system further comprises a processor electrically coupled with one or both of the first fluid sensor and the second fluid sensor.

According to an exemplary embodiment of the present disclosure, an inkjet printing system comprises a plurality of fluid reservoirs, each reservoir containing fluid, a fluid line that fluidly couples each fluid reservoir with an imaging device, and a fluid level sensing apparatus fluidly coupled with each fluid reservoir. The fluid level sensing apparatus comprises: a bottom portion having a fluid volume $V_B$; an intermediate portion vertically adjacent the bottom portion and having a fluid volume $V_I$, the intermediate portion including a first fluid sensor spaced vertically from a second fluid sensor; and an upper portion vertically adjacent the intermediate portion and having a fluid volume $V_U$, wherein $V_U>V_I>V_B$. The inkjet printing system further comprises a pump fluidly coupled to all of the fluid sensing apparatuses by a common fluid line and configured to exert fluid pressure along all of the fluid level sensing apparatuses.

According to an exemplary embodiment, at least one of the fluid level sensing apparatuses has an asymmetric configuration.

According to an exemplary embodiment, the inkjet printing system further comprises a vent fluidly coupled with all of the fluid level sensing apparatuses.

According to an exemplary embodiment, the inkjet printing system further comprises at least one valve disposed along the common fluid line.

According to an exemplary embodiment, the time the fluid takes to reach a respective first fluid sensor corresponds to a volume of fluid in a respective fluid reservoir.

According to an exemplary embodiment, the time the fluid takes to reach a respective second fluid sensor is used to calibrate a reading taken by the respective first fluid sensor.

According to an exemplary embodiment, each fluid level sensing apparatus is configured and dimensioned so that any nonzero amount of fluid in any fluid reservoir is pumped through a respective fluid level sensing apparatus over a sufficient amount of time so that any nonzero amount of fluid in any other fluid reservoir can be pumped through at least the respective intermediate portion of the respective fluid level sensing apparatus.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION OF EMBODIMENTS

Exemplary embodiments of the present disclosure are directed to apparatuses and methods for detecting fluid levels, such as ink levels, in inkjet printing systems. In embodiments, such apparatuses may be used to detect fluid levels along any portion of an inkjet printing system, such as a printhead, fluid line, ink cartridge, ink reservoir, and/or any location therebetween, to name a few. Such apparatuses may be used to alert one or more users to a fluid full condition, a fluid empty condition, and/or any condition therebetween.

Figure 1A:
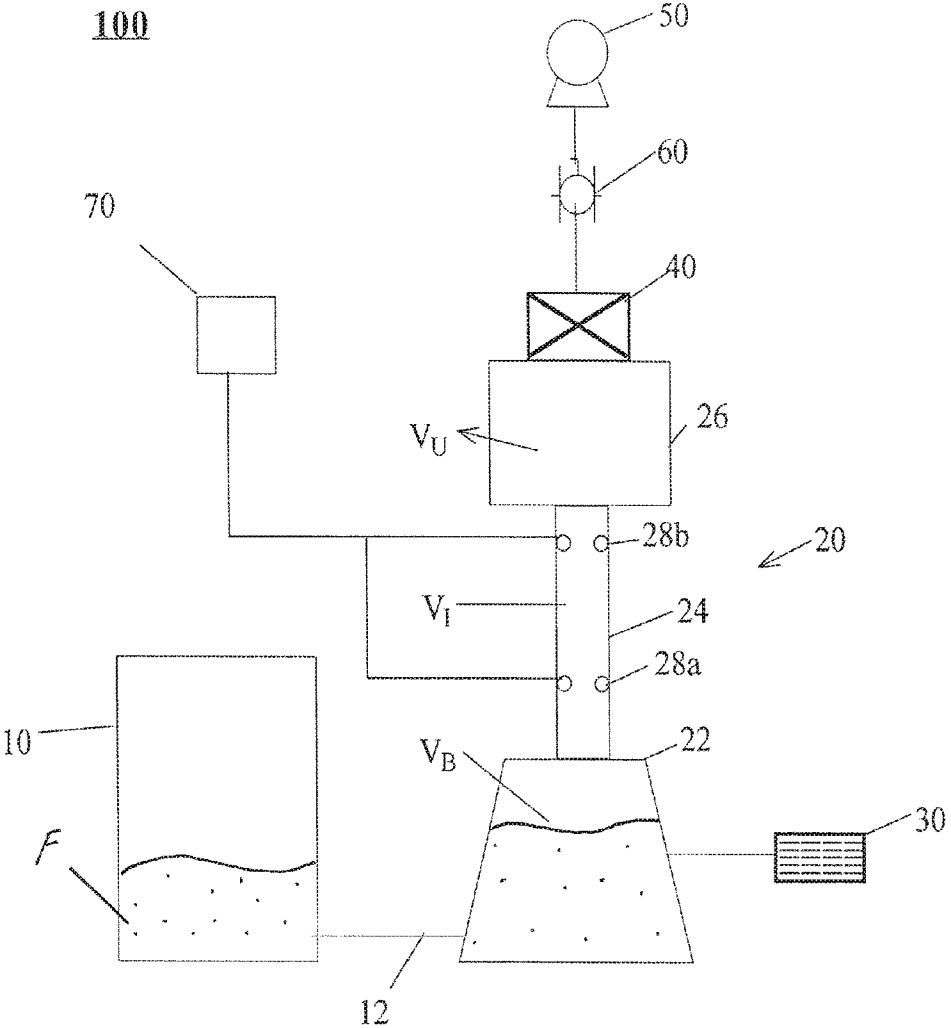
FIG. 1A is a first sequential schematic view of an inkjet printing system incorporating a fluid level sensing apparatus according to an embodiment of the present disclosure.

Turning to FIG. 1A, a system diagram of an inkjet printing system 100 is shown. Inkjet printing system 100 may include at least one fluid reservoir 10. Inkjet printing system 100 may include one or more fluid delivery lines 12, a fluid level sensing apparatus 20, an imaging device 30, and a pump 50. In embodiments, fluid reservoir 10 may be configured to contain a fluid F, for example, ink. In embodiments, fluid F may be an ink of any type, for example, color or composition. Imaging device 30 may be an inkjet printer or any component thereof, such as a printhead or other fluid ejection device. Inkjet printing system may include a vent 40, one or more valves 60, and/or a processor 70, as described further herein. In embodiments, fluid reservoir 10 may be, for example, an ink cartridge, an ink reservoir, or another type of ink storing member, to name a few.

Fluid reservoir 10 may be separated coupled with imaging device 30 via one or more fluid delivery lines 12. Fluid delivery line 12 may have an elongate, hollow configuration, such as a tubular member, configured to transmit fluids between fluid reservoir 10 and other portions of inkjet printing system 100. In embodiments, fluid delivery line 12 may be formed of any suitable material, such as a polymeric material. Fluid delivery line 12 may be transparent so that fluids being transmitted therethrough may be inspected, measured, analyzed, or otherwise sensed, for example, by a photodetector. In embodiments, fluid reservoir 10 may be directly fluidly coupled with imaging device 30.

Fluid level sensing apparatus 20 may be a portion of inkjet printing system 100 that is fluidly coupled with at least fluid reservoir 10. In embodiments, fluid level sensing apparatus 20 may be configured as a fluid path extending away from fluid line 12 and disposed between fluid reservoir 10 and imaging device 30. In embodiments, fluid level sensing apparatus 20 may include a portion of fluid reservoir 10 or imaging device 30. In embodiments, fluid level sensing apparatus may 20 have a symmetric configuration, such as a tubular column, or an asymmetric configuration. Fluid level sensing apparatus 20 may be formed of a similar material to fluid line 12, such as a polymeric material. In embodiments, fluid level sensing apparatus may have a transparent configuration.

Fluid level sensing apparatus 20 may include a first, bottom portion 22, a second, intermediate portion 24, and a third, upper portion 26. Bottom portion 22, intermediate portion 24, and upper portion 26 of fluid level sensing apparatus 20 may be in fluid communication with one another. In embodiments, bottom portion 22, intermediate portion 24, and upper portion 26 may be adjacent one another and fluidly coupled, for example, by fluid lines. Fluid level sensing apparatus 20 may be configured to be oriented so that bottom portion 22 is disposed closest to the ground or other surface supporting inkjet printing system 100, with intermediate portion 22 disposed above bottom portion 24, and upper portion 26 disposed above intermediate portion 24. In embodiments, bottom portion 22, intermediate portion 24, and upper portion 26 may have a substantially linear, vertical arrangement, such as a vertically stacked arrangement.

Each of bottom portion 22, intermediate portion 24, and upper portion 26 may have a distinct configuration, such as shape and/or dimensioning. Bottom portion 22 may be dimensioned to hold a fluid volume $V_B$, intermediate portion 24 may be dimensioned to hold a fluid volume $V_I$, and upper portion 26 may be dimensioned to a hold a fluid volume $V_U$. In embodiments, fluid level sensing apparatus 20 may be configured such that $V_U$ is larger than $V_I$ and/or $V_B$. In embodiments, fluid level sensing apparatus may be configured such that $V_U$ is larger than $V_I$ and $V_B$ is larger than $V_I$. In such embodiments, fluid level sensing apparatus 20 may be configured such that $V_U > V_B > V_I$.

Fluid level sensing apparatus 20 may include at least one sensor disposed therealong. In embodiments, fluid level sensing apparatus 20 may include a first sensor 28*a* and a second sensor 28*b* vertically spaced from the first sensor 28*a*. Sensors 28*a*, 28*b* may be configured to detect the presence, quantity, and/or chemical properties of fluid disposed therein. In embodiments, sensors 28*a*, 28*b* may be configured to generate an electrical signal, such as an electrically conductive member, such as a pin, with conductive properties that change in the presence of a fluid. In embodiments, sensors 28*a*, 28*b* may be configured floating members that can rise and fall in the presence of fluid, or light-detecting members such as photodetectors, to name a few. Sensors 28*a*, 28*b* may be disposed externally and/or internally along a portion of fluid level sensing apparatus 20. Fluid level sensing apparatus 20 may include one, two, or more than two of each sensor 28*a*, 28*b*.

Sensors 28*a*, 28*b* may be configured so that, upon contact with a fluid, sensors 28*a*, 28*b* provide an indication to a user, such an audible and/or visual indicator. In such embodiments, an indicator may be a light such as an LED, an indicium on a visual display, and/or an audible alarm.

A vent 40 may be disposed above fluid level sensing apparatus 20. In embodiments, vent 40 may be substantially vertically adjacent upper portion 26 of fluid sensing apparatus 20 and fluidly coupled with the fluid level sensing apparatus 20. Vent 40 may comprise one or more openings for fluids to exit fluid sensing apparatus 20. Vent 40 may be configured to facilitate the release or intake of fluid pressure to achieve a desired pressure environment within inkjet printing system 100, for example, equilibrium with a surrounding environment. Vent 40 may have an open or closed condition. In embodiments, vent 40 may be in fluid communication with a storage container or recirculation system.

A pump 50 may be in fluid communication with fluid level sensing apparatus 20. Pump 50 may be any suitable fluid pressure-generating member, and may be configured to generate one or more pressure differentials along fluid level sensing apparatus 20 so that fluids disposed therein are caused to move through fluid level sensing apparatus 20. In embodiments, a pump 50 may be disposed above vent 40. In embodiments, a pump 50 may be disposed along a portion of fluid level sensing apparatus 20. In embodiments, an inkjet printing system 100 may include multiple pumps 50 for use with fluid level sensing apparatus 20.

One or more valves 60 may be disposed along fluid level sensing apparatus 20. In embodiments, valves 60 may be disposed upstream and/or downstream of fluid sensing apparatus 20, vent 40 and/or pump 50. Valves 60 may be configured to inhibit fluid flow in at least one direction, for example, to inhibit leaks, backflow, and the like.

Still referring to FIG. 1A, inkjet printing system 100 is shown with fluid reservoir 10 being partially filled with fluid F and with vent 40 in a closed condition. A residual pressurized environment, for example, from prior printing operations, may be present within portions of inkjet printing system 100.

Figure 1B:
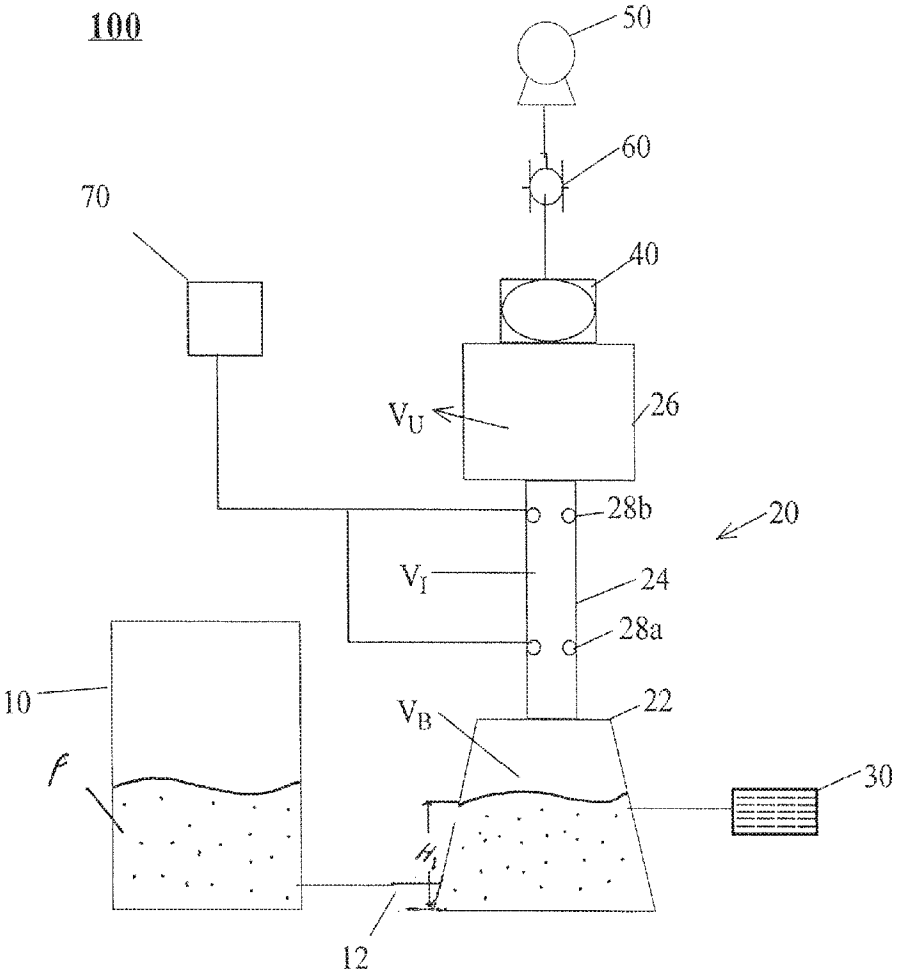
FIG. 1B is a second sequential schematic view of an inkjet printing system incorporating a fluid level sensing apparatus according to an embodiment of the present disclosure.

Turning to FIG. 1B, vent 40 may be opened such that a fluid pressure within inkjet printing system 100 is returned to an equilibrium state with respect to a surrounding environment. Accordingly, the level of fluid F present in fluid reservoir 10 is caused to sit at a resting level, for example, under atmospheric pressure, within inkjet printing system 100. In embodiments, fluid F has a resting level within fluid level sensing apparatus 20 that is determined by the initial volume of fluid F in fluid reservoir 10. As shown, fluid F may sit at a vertical height $H_I$ that is substantially similar to a vertical height of fluid F in the fluid reservoir 10. In embodiments, a resting level of fluid F in fluid level sensing apparatus 20 may be within bottom portion 22, intermediate portion 24, or upper portion 26 of fluid level sensing apparatus 20.

Figure 1C:
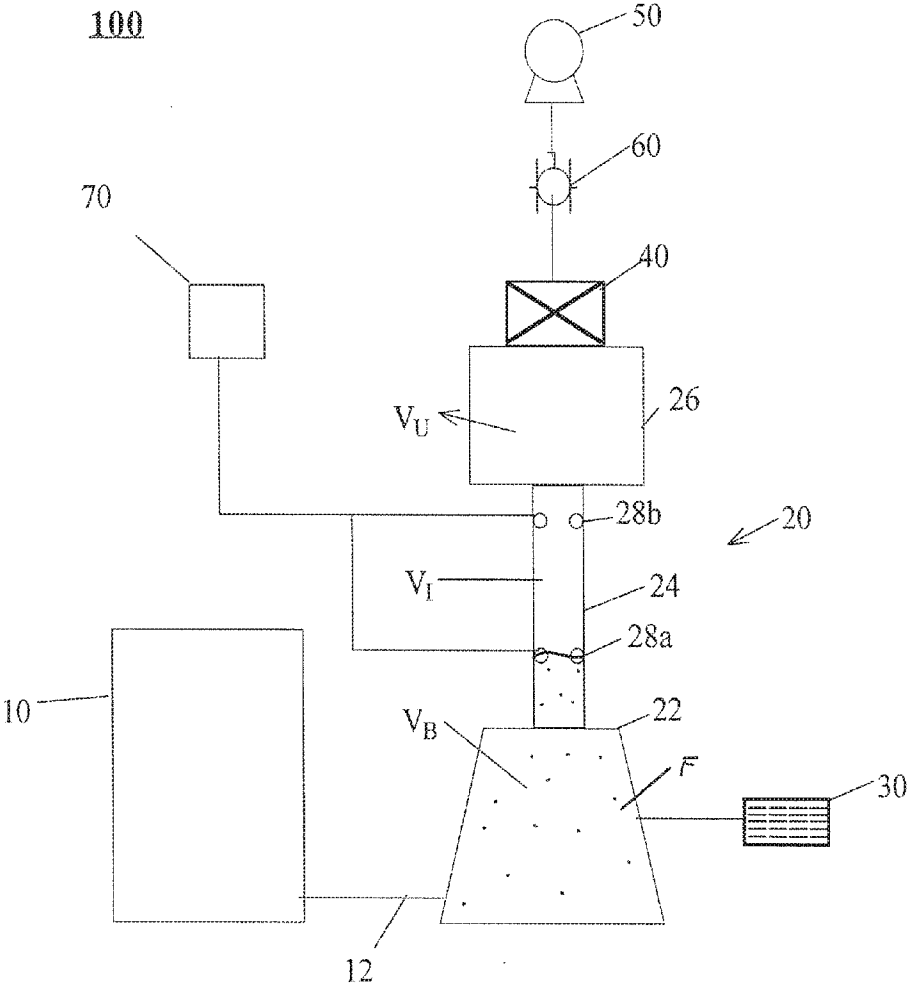
FIG. 1C is a third sequential schematic view of an inkjet printing system incorporating a fluid level sensing apparatus according to an embodiment of the present disclosure.

Referring to FIG. 1C, vent 40 may be closed and pump 50 may be actuated upon a signal received from imaging device 30, a user input, or another condition, so that fluid F is caused to rise within fluid level sensing apparatus 20. Upon further operation of pump 50, fluid F may rise within fluid sensing apparatus 20 to reach first sensor 28*a*. Fluid F may reach first sensor 28*a* in a period of time dependent upon the amount of fluid F present in fluid reservoir 10 so that fluid F may reach first sensor 28*a* in a shorter period of time if fluid reservoir 10 is substantially filled as compared to a longer period of time if fluid reservoir 10 is less than substantially filled due to the initial resting level of fluid F within fluid level sensing apparatus 20. First sensor 28*a* may detect the presence of fluid F and generate a corresponding signal. In such embodiments, such a signal may correspond to a recorded time that fluid F reached first sensor 28*a* as compared to an initial time recorded when fluid F is at a resting level within the fluid level sensing apparatus 20.

In embodiments, pump 50 may exert a negative fluid pressure on fluid F that is different from the known or expected capabilities of pump 50, and/or the resulting volume flow rate of fluid F through the fluid level sensing apparatus 20 may be different than expected, for example, due to variable pump performance, power supply, fluid consistency, or other factors, to name a few.

Figure 1D:
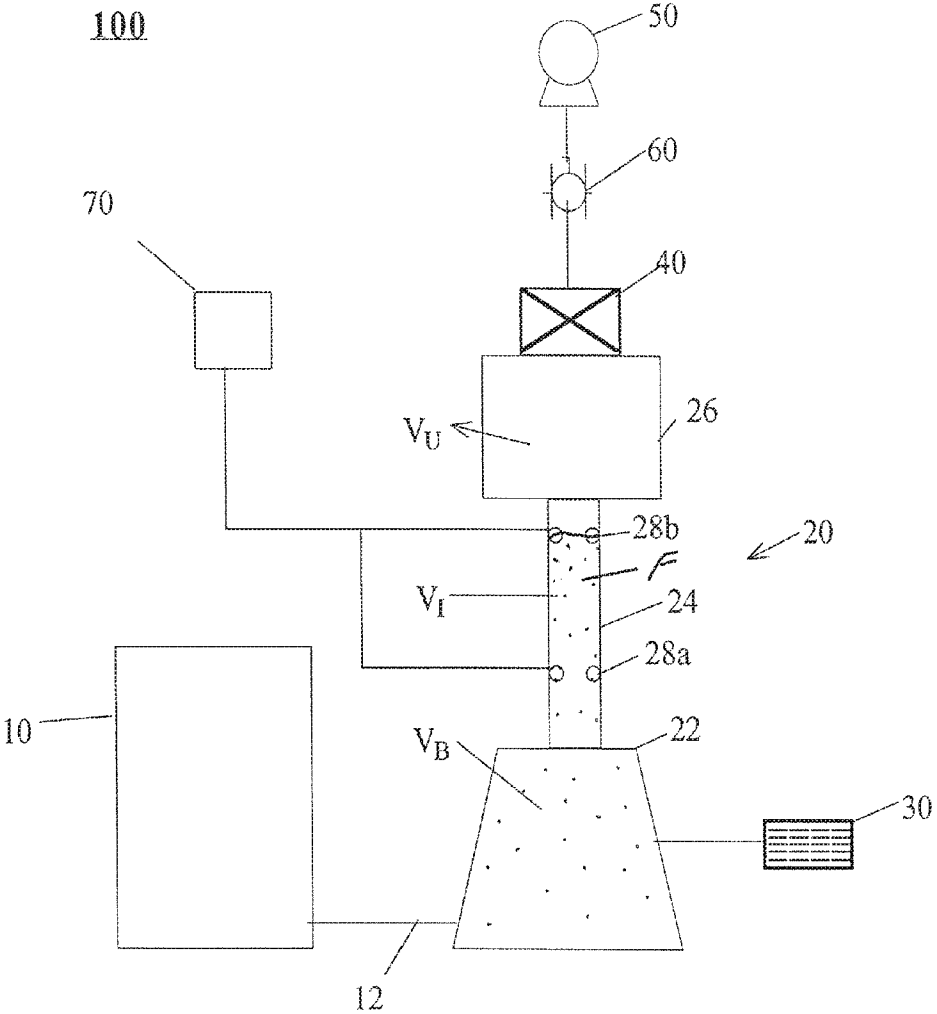
FIG. 1D is a fourth sequential schematic view of an inkjet printing system incorporating a fluid level sensing apparatus according to an embodiment of the present disclosure.

With reference to FIG. 1D, further operation of pump 50 may cause fluid F to rise through intermediate portion 24 of fluid sensing apparatus 20. When fluid F reaches second sensor 28*b*, a signal may be generated. With a known flow rate of the pump 50, and known volume $V_I$ of the intermediate portion 24, the time differential between the time at which fluid F reaches first sensor 28*a* and the time at which fluid F reaches second sensor 28*b* may correspond to the actual flow rate of the fluid F through the fluid level sensing apparatus 20 as compared to the expected flow rate of the fluid F through the fluid level sensing apparatus 20. In this manner, second sensor 28*b* may be used to calibrate the measurement of the time fluid F takes to reach first sensor 28*b* by accounting for local variations of the pump 50, fluid F, etc. In embodiments, multiple additional sensors may be used in conjunction with first sensor 28 to improve accuracy of the readings taken of fluid F traveling through fluid level sensing apparatus 20.

In embodiments, inkjet printing system 100 may include a processor 70 for calculating the time differentials between the actuation of the pump 50 and the fluid F reaching the first sensor 28*a*, and/or the time differential between the fluid F reaching first sensor 28*a* and second sensor 28*b*. Processor 70 may also be used, for example, to calibrate the reading taken by the first sensor 28*a* based on the reading taken by second sensor 28*b*. Processor 70 may be electrically coupled with either or both of sensors 28*a*, 28*b*. In embodiments, processor 70 may include a portion of imaging device 30, fluid sensing apparatus 20, or any other portion of inkjet printing system 100.

Figure 1E:
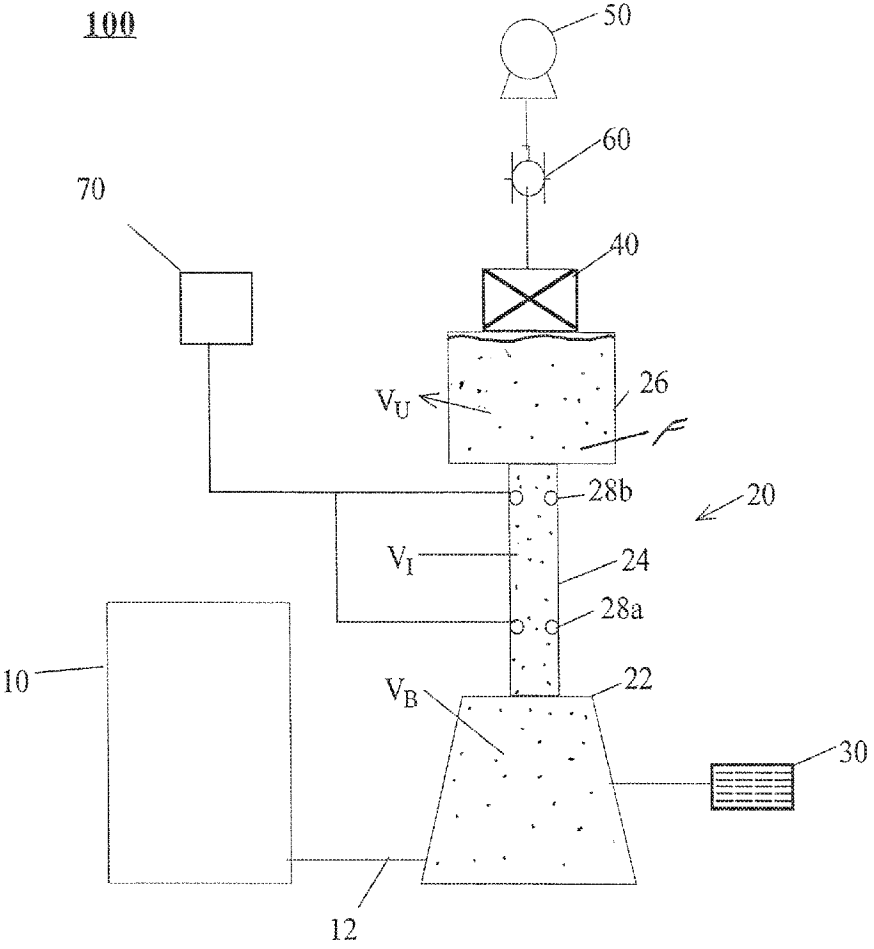
FIG. 1E is a fifth sequential schematic view of an inkjet printing system incorporating a fluid level sensing apparatus according to an embodiment of the present disclosure.

Referring to FIG. 1E, further operation of pump 50 may cause fluid F to rise into upper portion 26 of fluid sensing apparatus 20 and fill volume $V_U$. Thereafter, fluid F reaches vent 40 and begins to exit fluid sensing apparatus 20. In embodiments, fluid sensing apparatus 20 may be configured such that a sensor is associated with vent 40 so that upon reaching vent 40, pump 50 is shut down. Fluid F may thereafter fall through fluid sensing apparatus 20 to a resting vertical height, such as similar to that shown in FIG. 1A or 1B.

Figure 2A:
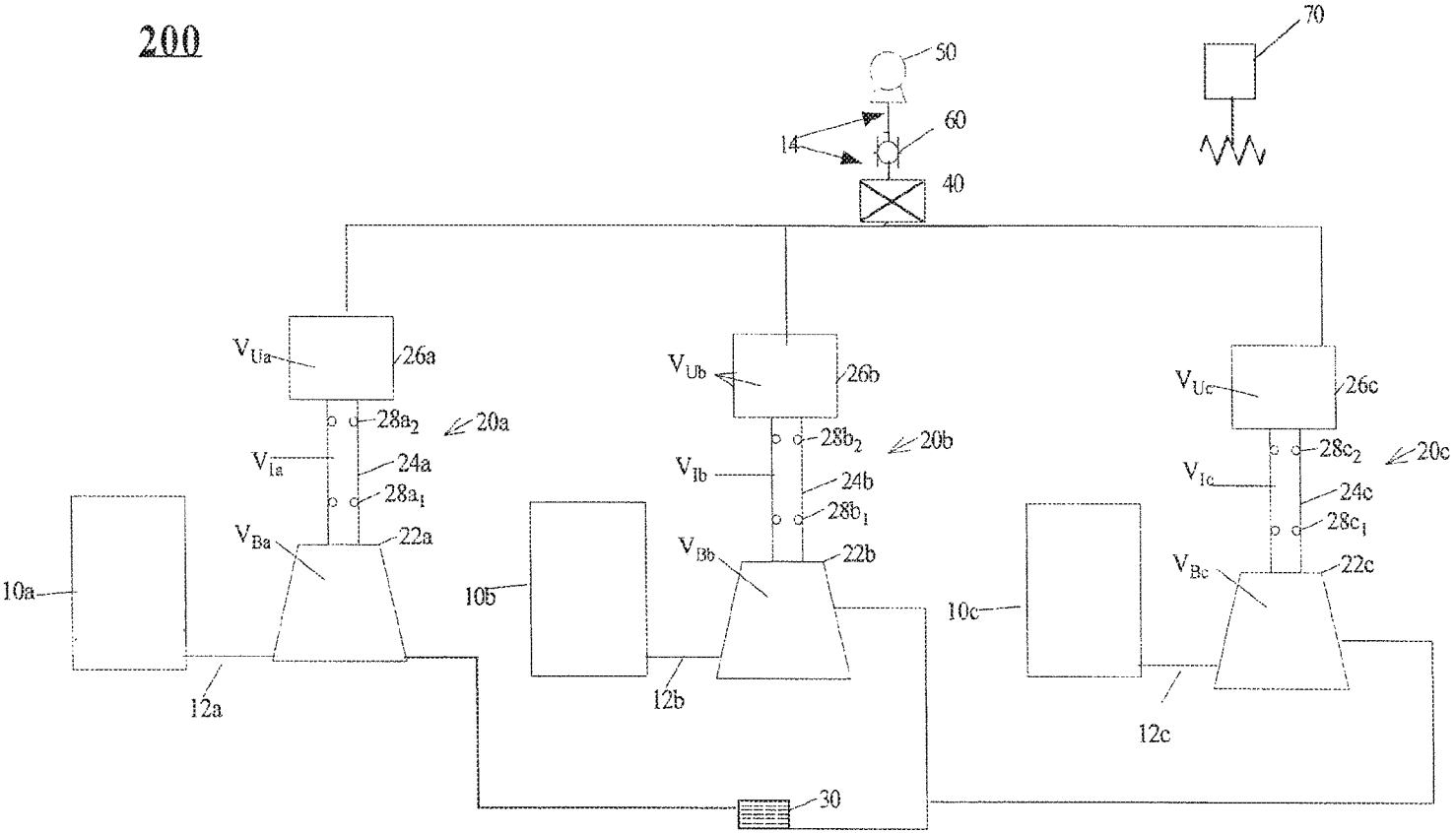
FIG. 2A is a first sequential schematic view of an inkjet printing system incorporating multiple fluid level sensing apparatuses according to an embodiment of the present disclosure.

Turning to FIG. 2A, an embodiment of an inkjet printing system, generally designated 200, is shown. Inkjet printing system 200 may include substantially similar components to inkjet printing system 100 above, such as an imaging device 30, vent 40, pump 50, valve 60, and processor 70. However, inkjet printing system may include a plurality of ink reservoirs 10*a*, 10*b*, 10*c* each containing fluid F (FIG. 2B), and each with a respective fluid line 12*a*, 12*b*, 12*c* fluidly coupling each respective fluid reservoir 10*a*, 10*b*, 10*c* with imaging device 30. In embodiments, fluid reservoirs 10*a*, 10*b*, 10*c* may contain a similar or identical fluid, or may include different fluids, such as different colored ink. A fluid sensing apparatus 20*a*, 20*b*, 20*c* is fluidly coupled with each respective fluid reservoir 10*a*, 10*b*, 10*c*. Each fluid level sensing apparatus 20*a*, 20*b*, 20*c* may each include a respective bottom portion 22*a*, 22*b*, 22*c*, intermediate portion 24*a*, 24*b*, 24*c*, and upper portion 26*a*, 26*b*, 26*c*. Each respective bottom portion 22*a*, 22*b*, 22*c* may have a fluid volume $V_{Ba}$, $V_{Bb}$, $V_{Bc}$, each respective intermediate portion 24*a*, 24*b*, 24*c* may have a fluid volume $V_{Ia}$, $V_{Ib}$, $V_{Ic}$, and each respective upper portion 26*a*, 26*b*, 26*c* may have a fluid volume $V_{Ua}$, $V_{Ub}$, $V_{Uc}$. Ink reservoirs 10*a*, 10*b*, 10*c*, respective fluid lines 12*a*, 12*b*, and 12*c*, and fluid sensing apparatuses 20*a*, 20*b*, 20*c* may be similar to ink reservoir 10, fluid line 12, and fluid sensing apparatus 20 described above.

Each respective fluid sensing apparatus 20*a*, 20*b*, 20*c* may have a respective first sensor $28a_1$, $28b_1$, $28c_1$ and second sensor $28a_2$, $28b_2$, $28c_2$ which may be similar to first and second sensors 28*a*, 28*b* described above. Pump 50 and/or vent 40 may be fluidly coupled via a common fluid line 14 to all of the fluid sensing apparatuses 20*a*, 20*b*, 20*c* and configured to exert fluid pressure therealong.

Figure 2B:
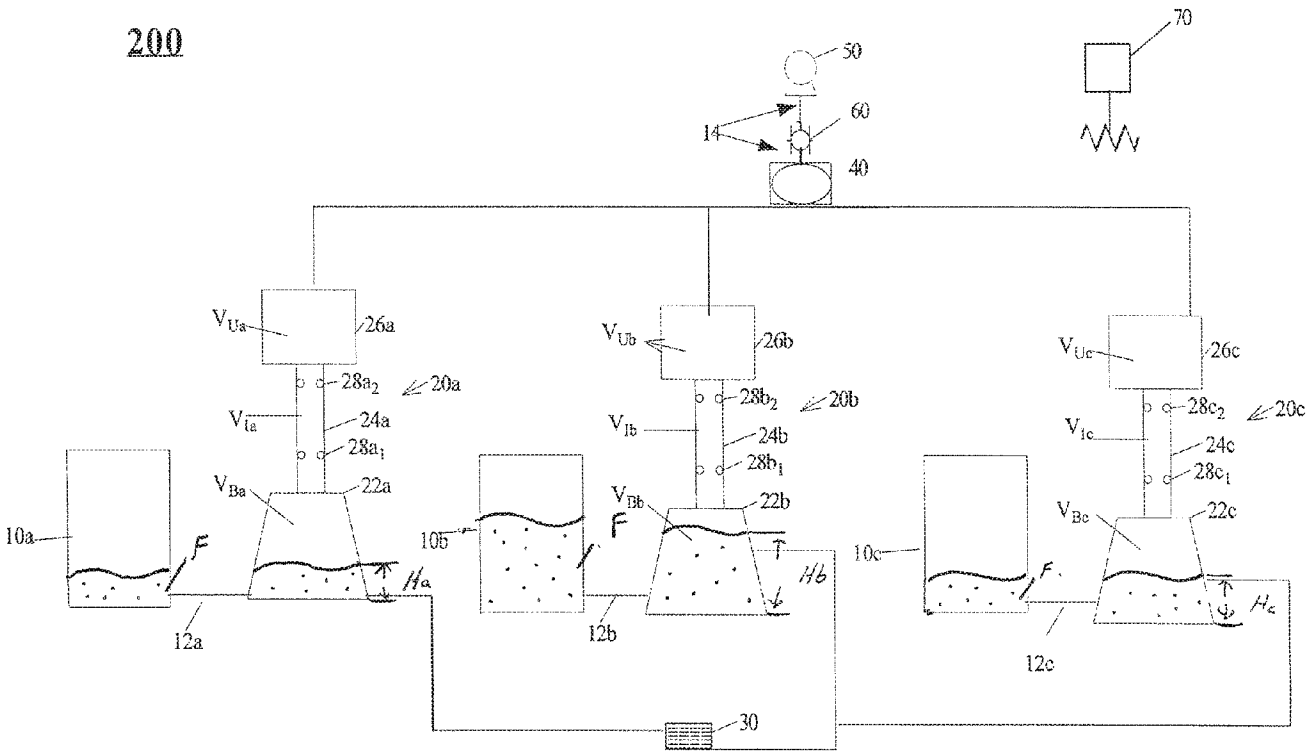
FIG. 2B is a second sequential schematic view of an inkjet printing system incorporating multiple fluid level sensing apparatuses according to an embodiment of the present disclosure.

Referring to FIG. 2B, fluid reservoir 10*b* may be substantially filled with fluid F, and fluid reservoirs 10*a*, 10*c* may be partially filled with fluid F. In embodiments, fluid reservoirs 10*a*, 10*b*, 10*c* may be filled in any combination or variation. Vent 40 may be opened in an initial configuration so that fluid pressure within inkjet printing system 200 returns to an equilibrium state and levels of fluid F may be disposed at resting vertical heights within fluid level sensing apparatuses 20*a*, 20*b*, 20*c* of $H_a$, $H_b$, $H_c$, respectively.

Figure 2C:
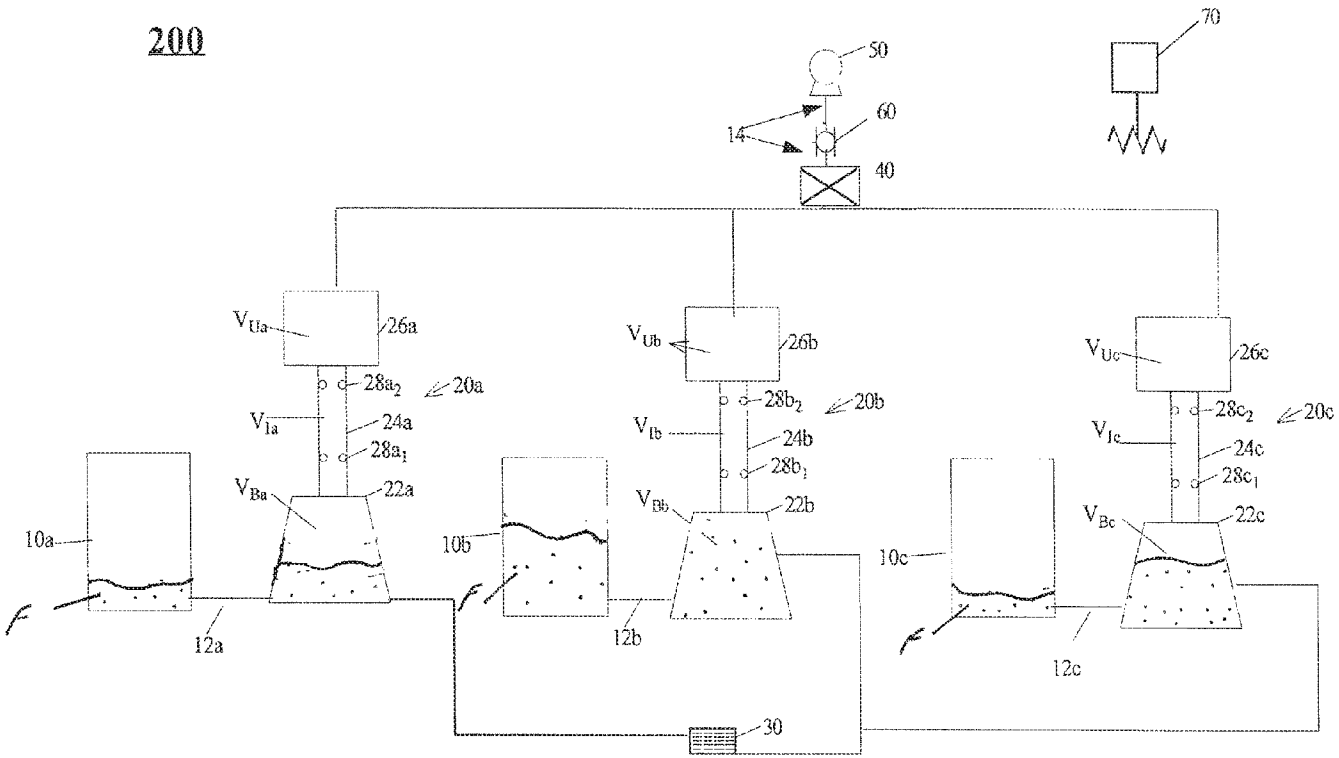
FIG. 2C is a third sequential schematic view of an inkjet printing system incorporating multiple fluid level sensing apparatuses according to an embodiment of the present disclosure.

Turning to FIG. 2C, upon actuation of pump 50, fluid F may rise within each fluid sensing apparatuses 20*a*, 20*b*, 20*c* and contact respective first sensors $\mathbf{28}a_1$, $\mathbf{28}b_1$, $\mathbf{28}c_1$ in the manner described above with respect to inkjet printing system 100.

Figure 2D:
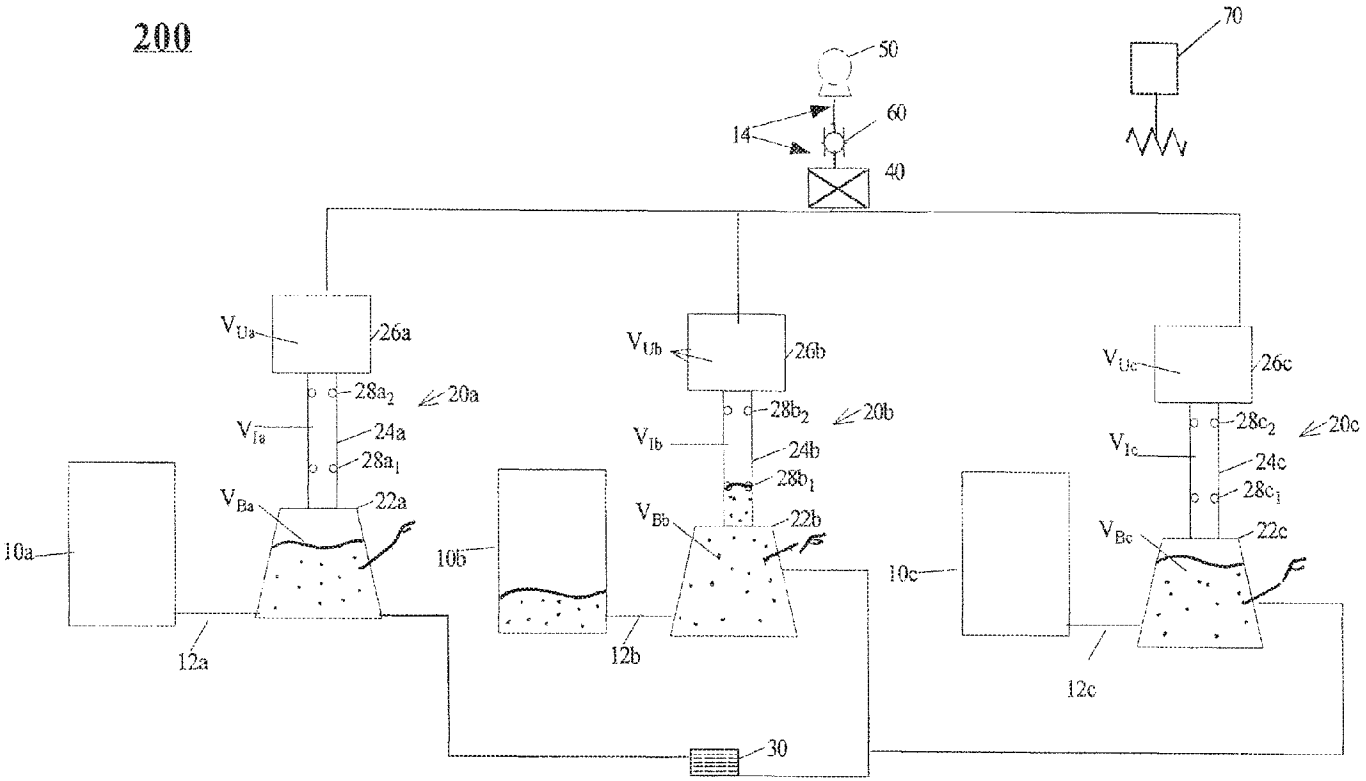
FIG. 2D is a fourth sequential schematic view of an inkjet printing system incorporating multiple fluid level sensing apparatuses according to an embodiment of the present disclosure.

Turning to FIG. 2D, further operation of pump 50 may cause fluids F to rise within intermediate portions 24*a*, 24*b*, 24*c* of fluid sensing apparatuses 20*a*, 20*b*, 20*c*. As shown, fluid F from the first fluid reservoir 10*b* may be pumped through fluid level sensing apparatus 20*b* to vent 40 before fluid F from the partially-filled fluid reservoirs 10*a* and 10*c* is completely pumped through respective fluid level sensing apparatuses 20*a* and 20*c*. Since contact of fluid F with the vent 40 may cause a shutdown of the pump 50, such a discrepancy in fluid levels among different fluid reservoirs along a common pump line may cause premature termination of a fluid level sensing operation before all fluid reservoirs are properly measured.

Figure 2E:
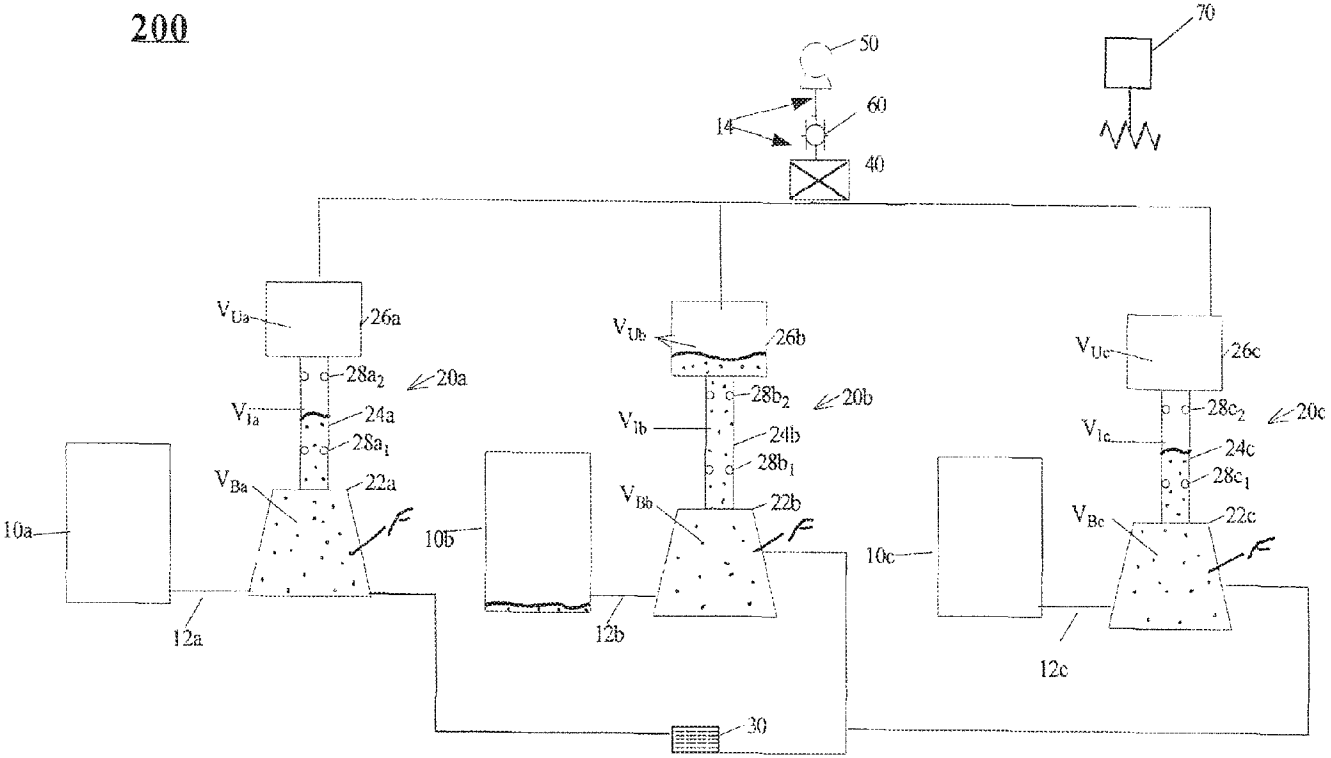
FIG. 2E is a fifth sequential schematic view of an inkjet printing system incorporating multiple fluid level sensing apparatuses according to an embodiment of the present disclosure.

However, with additional reference to FIG. 2E, because the fluid volume $V_{Ub}$, upper portion 26*b* of fluid sensing apparatus 20*b* is greater than the volume $V_{Ib}$ of intermediate portion 26*b*, any nonzero volume of fluid F initially in fluid reservoir 10*b* may be pumped through fluid line 12*b* and fluid level sensing apparatuses 20*b* over a sufficient period of time before reaching vent 40 so that fluid F in fluid reservoirs 10*a*, 10*c* has sufficient time to be pumped through and fill at least intermediate portions 24*a*, 24*c* of fluid sensing apparatuses 20*a*, 20*c* before the fluid F initially in fluid reservoir 10*b* reaches vent 40, which may cause a shutdown of pump 50. In this manner, inkjet printing system 200 is configured so that multiple fluid reservoirs 10*a*, 10*b*, 10*c* may be coupled to a common fluid line 14 and simultaneously pumped through respective fluid sensing apparatuses 20*a*, 20*b*, 20*c* in a manner so that any nonzero volume of fluid F in each of fluid reservoirs 10*a*, 10*b*, 10*c* is sufficient to allow proper sensing of levels of fluid F in all fluid reservoirs 10*a*, 10*b*, 10*c* before fluid F from one of fluid reservoirs 10*a*, 10*b*, 10*c* is pumped through vent 40. In this manner, inkjet printing system 200 is configured and dimensioned so that multiple fluid reservoirs may be coupled with a common pump and/or fluid line and be measured with respect to fluid levels therein regardless of the volume of fluid initially stored therein, without any one fluid reservoir interrupting operation of the measurement of the fluid level of any other fluid reservoir.

In embodiments, fluid F may be evacuated through vent 40 without causing a shutdown of the pump 50. In such embodiments, the configuration of the fluid level sensing apparatuses 20*a*, 20*b*, 20*c* is such that a fluid F may be pumped therethrough over a sufficient period of time so that proper sensing may be performed of all fluid reservoirs before any one fluid reservoir and respective fluid sensing apparatus is completely evacuated of fluid F, which may cause improper operation of pump 50.

Figure 3A:
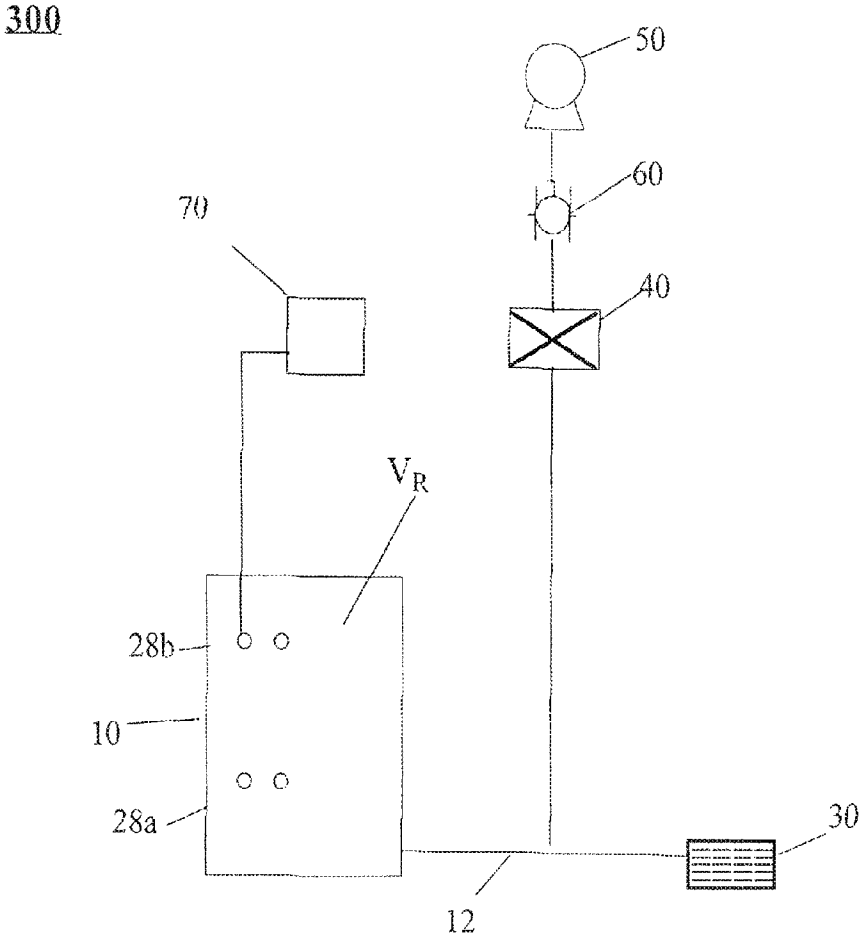
FIG. 3A is a first sequential schematic view of an inkjet printing system incorporating multiple fluid level sensing apparatuses according to an embodiment of the present disclosure.

Turning to FIG. 3A, an embodiment of an inkjet printing system, generally designated 300, is shown. Inkjet printing system 300 may include some similar components to inkjet printing system 200 described above, such as an imaging device 30, vent 40, pump 50, valve 60, and/or processor 70. However, inkjet printing system 300 may include fluid reservoir 11 which has a fluid volume $V_R$. Sensors 28*a*, 28*b* may be incorporated or associated with the fluid reservoir 11 as described above.

Figure 3B:
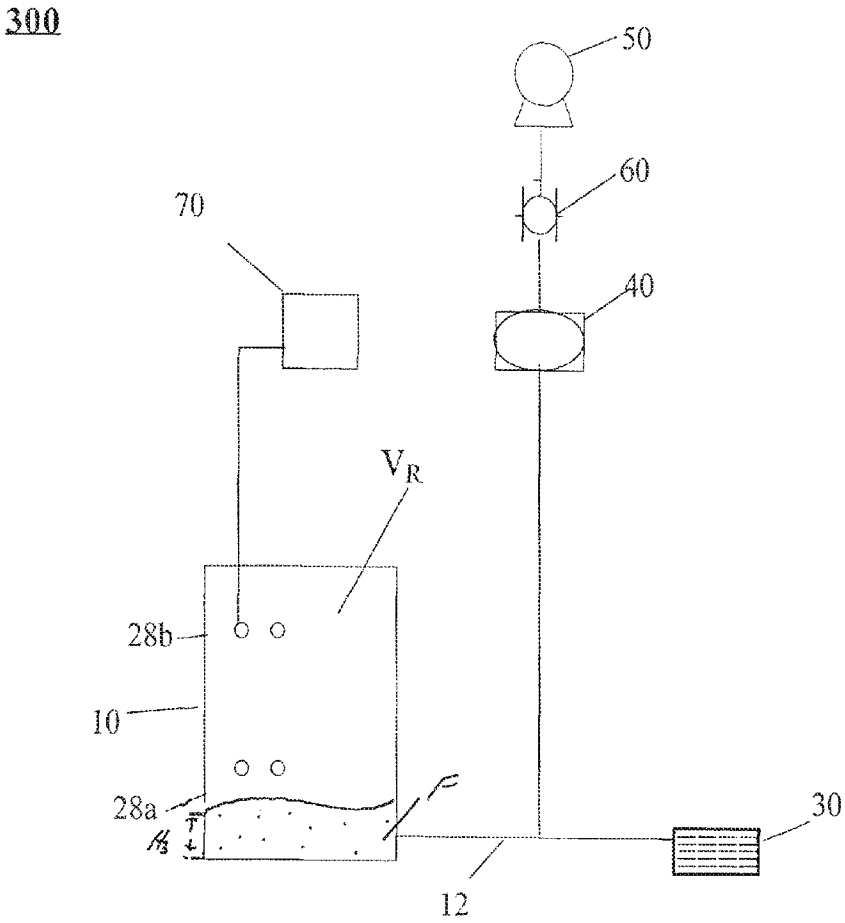
FIG. 3B is a second sequential schematic view of an inkjet printing system incorporating multiple fluid level sensing apparatuses according to an embodiment of the present disclosure.

Turning to FIG. 3B, vent 40 may be opened to allow fluid pressure within inkjet printing system 300 to return to equilibrium and allow fluid F to become disposed at a resting level $H_3$.

Figure 3C:
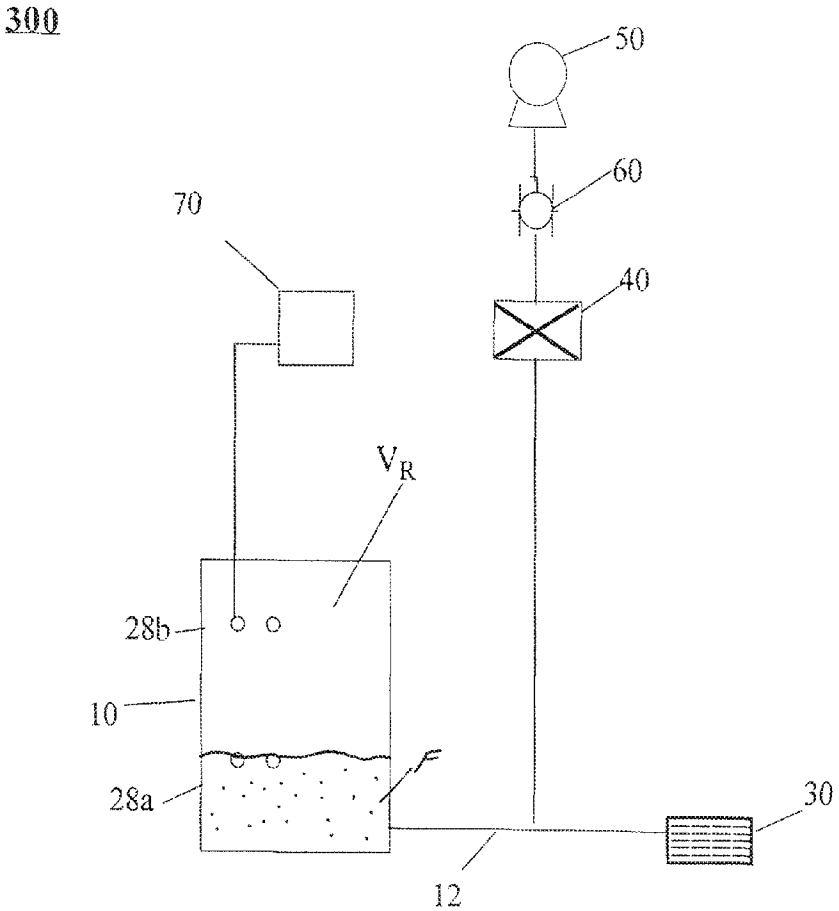
FIG. 3C is a third sequential schematic view of an inkjet printing system incorporating multiple fluid level sensing apparatuses according to an embodiment of the present disclosure.

Turning to FIG. 3C, vent 40 may be closed and pump 50 may be actuated to provide fluid pressure through line 12 such that fluids F in fluid reservoir 11 rise vertically. The time fluid F takes to reach first sensor 28*a* may correspond to a volume of fluid F present in the fluid reservoir 11 due to the initial proximity of fluid F to first sensor 28*a* within fluid level sensing apparatus 20. Second sensor 28*b* may be provided to calibrate the reading taken by first sensor 28*a* in the manner described above with respect to inkjet printing systems 100, 200. It will be understood that such a configuration may be employed with respect to inkjet printing systems 100, 200 described above.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid printing device, comprising:

a fluid path that comprises at least two parts;

a pump that generates a pressure differential in the fluid path;

a valve that inhibits flow of a fluid through the fluid path in a direction away from the pump; and a vent disposed adjacent to the valve that facilitates release or intake of fluid pressure.

2. The fluid printing device of claim 1, wherein the at least two parts of the fluid path comprise a first container and a second container.

3. The fluid printing device of claim 2, wherein a shape of the first container is different from a shape of the second container.

4. The fluid printing device of claim 2, wherein a capacity of the first container is different from a capacity of the second container.

5. The fluid printing device of claim 4, wherein the capacity of the second container is less than the capacity of the first container.

6. The fluid printing device of claim 2, wherein the first and second containers have a cylindrical shape.

7. The fluid printing device of claim 6, wherein a diameter of the first container is different from a diameter of the second container.

8. The fluid printing device of claim 2, wherein a center of the first container is aligned with a center of the second container.

9. The fluid printing device of claim 2, wherein the first container has a trapezoidal shape.

10. The fluid printing device of claim 2, wherein the first and second containers are arranged vertically relative to one another.

11. The fluid printing device of claim 10, further comprising a third container arranged above the second container.

12. The fluid printing device of claim 11, wherein a center of the second container is aligned with a center of the third container.

13. The fluid printing device of claim 2, wherein the second container comprises at least one sensor.

14. The fluid printing device of claim 13, wherein the at least one sensor comprises two sensors arranged vertically relative to one another at different positions.

15. The fluid printing device of claim 2, wherein the at least two parts of the fluid path form a fluid level sensing apparatus.

16. The fluid printing device of claim 1, further comprising at least one fluid reservoir that provides a source of fluid to the fluid path.

17. The fluid printing device of claim 16, further comprising an imaging device.

18. The fluid printing device of claim 17, wherein the fluid path, the pump, the valve and the vent are arranged between the at least one fluid reservoir and the imaging device.

19. The fluid printing device of claim 1, wherein the fluid path, the vent, the valve and the pump are arranged vertically relative to one another in the following order from bottom to top: 1) the fluid path; 2) the vent; 3) the valve; and 4) the pump.

* * * * *